US007266912B2

(12) United States Patent
Whatley

(10) Patent No.: US 7,266,912 B2
(45) Date of Patent: Sep. 11, 2007

(54) EXERCISE SOLE

(76) Inventor: Ian H. Whatley, 5630 SE. Gladstone, Portland, OR (US) 97206

( * ) Notice: Subject to any disclaimer, the term of this patent is extended or adjusted under 35 U.S.C. 154(b) by 0 days.

(21) Appl. No.: 10/883,388

(22) Filed: Jul. 1, 2004

(65) Prior Publication Data

US 2005/0160625 A1 Jul. 28, 2005

Related U.S. Application Data

(63) Continuation of application No. 10/655,413, filed on Sep. 4, 2003, now abandoned, which is a continuation of application No. 10/341,010, filed on Jan. 13, 2003, now abandoned, which is a continuation of application No. 09/833,485, filed on Apr. 12, 2001, now abandoned, which is a continuation of application No. 08/900,552, filed on Jul. 25, 1997, now abandoned.

(60) Provisional application No. 60/037,652, filed on Jan. 22, 1997.

(51) Int. Cl.
*A43B 5/00* (2006.01)
*A63B 23/08* (2006.01)

(52) U.S. Cl. ..... 36/132; 482/79

(58) Field of Classification Search ..... 36/132, 36/25 R, 103
See application file for complete search history.

(56) References Cited

U.S. PATENT DOCUMENTS 4,348,821 A * 9/1982 Daswick ..... 36/103
4,506,462 A * 3/1985 Cavanagh ..... 36/92
5,592,757 A * 1/1997 Jackinsky ..... 36/114

FOREIGN PATENT DOCUMENTS

FR 1128009 * 1/1957

OTHER PUBLICATIONS

The Effect of the Merdian Shoe on Verticla Jump and Spring Performances Following Short-Term Combined Plyometric/Spring and Resistance Training; Journa of Strength and Conditioning Research 2000, pp. 228-238.*

* cited by examiner

*Primary Examiner*—Ted Kavanaugh
(74) *Attorney, Agent, or Firm*—Woodard, Emhardt, Moriarty, McNett & Henry LLP

(57) ABSTRACT

An improved exercise device including a sole with an upper surface on which a wearer's foot rests and a lower partially ground contacting surface. The sole has a heel, a midfoot, a forefoot and a toe region such that when the heel region lower surface and the forefoot region lower surface are in ground contact, the upper surface does not incline upwards from the forefoot to the heel region. The forefoot lower surface of the sole is generally radiused in a cylindrical curve about the line connecting the mid points of the first and second metatarsal-phalangeal joints of the wearer. When the wearer contracts their calf muscles, the heel section is lifted away from the ground, requiring work against gravity.

20 Claims, 11 Drawing Sheets

EXERCISE SOLE

REFERENCE TO RELATED APPLICATIONS

The present application is a continuation of U.S. patent application Ser. No. 10/655,413 filed Sep. 4, 2003 now abandoned, which is a continuation of U.S. patent application Ser. No. 10/341,010 filed Jan. 13, 2003, abandoned, which is a continuation of U.S. patent application Ser. No. 09/833,485 filed Apr. 12, 2001, abandoned, which is a continuation of U.S. patent application Ser. No. 08/900,552 filed Jul. 25, 1997, abandoned, which claims the benefit of U.S. Provisional Patent Application, Ser. No. 60/037,652, filed Jan. 22, 1997, each of which is hereby incorporated by reference in its entirety.

BACKGROUND OF THE INVENTION

This invention relates to soles for an article of footwear, specifically to an improved exercise-providing sole for an article of footwear.

The discussion below is provided to assist the understanding of the reader. None of the information provided or references cited is admitted to be prior art to the present invention.

Jumping, running, plyometric exercise and power walking have grown in popularity over the last few years. Footwear and overshoes have been designed to improve muscle conditioning during these movements by increasing the angle through which the ankle flexes. This works the calf muscles through a more full range of motion than is possible in traditional footwear. The effect is achieved by placing the vertically thickest section of the sole forward of the heel.

Some soles have been designed providing a rocker structure with an elevated heel. Examples of this include Famolare, U.S. Pat. No. 3,936,956, Daswick, U.S. Pat. No. 4,241,523 and Spronken, U.S. Pat. No. 4,425,721.

Some references describe a sole with a thicker section forward of the heel without a rocker structure. This structure has been associated with a forefoot to ground slapping motion which may cause injury to the wearer. Examples of this include Monier, U.S. Pat. No. 2,769,252, Cox, U.S. Pat. No. 3,739,500 and Nakamoto, U.S. Pat. No. 3,859,727.

Other structure are described in which the thickest vertical section of the sole is behind the metatarsal heads. Examples of this structure include Newell, U.S. Pat. No. 3,602,424, Phillips, U.S. Pat. No. 4,155,180 and Bunke, U.S. Pat. No. 4,811,504.

Other structures are descried that place a vertically thickest sole section forward of the distal metatarsal joints of a wearer's foot. Examples of this include Wenker, U.S. Pat. No. 2,172,000 and Baker, U.S. Pat. No. 3,472,508.

A number of alternative radii and alignments of sole structure have been described. For example, Kalsoy, U.S. Pat. No. 3,305,947 describes a sole structure having a curved bottom to transfer weight from the outer portion of the heel to the big toe during a step, Banister, U.S. Pat. No. 2,283,595 describes a stilt structure attachable to shoes which has a compound curve on the lower surface, Witherill, U.S. Pat. No. 2,328,242 describes a sole structure which has generally the contours of a human foot, and Urban, U.S. Pat. No. 2,519,613 describes a protective device which is attachable to a shoe sole and which prevents contact of the toe of the shoe with the ground during normal walking.

SUMMARY OF THE INVENTION

This invention provides soles for shoes which allow a full range of motion for the calf muscles in exercise, provide a continuous rolling motion for the forefoot, provide a forefoot rolling action aligned with the primary point of force exertion in jumping and provide a forefoot sole radius length appropriate for exercise of the calf muscles.

The soles of this invention can also reduce the forefoot to ground slapping action, allow grading of the sole radius according to foot dimensions and reduce the abrasion wear which occurs in relatively flat soles.

The peak pressure in jumping off the ground is exerted between the first and second metatarsal bones at their joints with the phalanges. These are two hinge joints with a common axis oriented at about 90° to the longitudinal axis of the shoe sole in a plane about parallel to the ground. In order to permit a smooth contraction of the calf muscle during exercise, the ground contacting surface of the sole should form a cylindrically curved surface radiused about a line generally connecting the midpoints of the first and second metatarsal-phalangeal joint. It is preferable that the cylindrically curved portion of the ground contacting surface is a curve of a circular cylinder, however, the curvature need only approximate that shape. Thus, the curvature may be slightly elliptical or of variable or other curvature which approximates a circular curvature.

Thus, the invention features a sole structure for attachment to an upper to form an article of footwear or for attachment to an existing article of footwear.

The term "sole" is used, as the term is commonly used, to include all those elements of an article of footwear which are attached below the upper. These may typically include such items as a midsole, an outsole, shock attenuating components and stabilizing components.

The term "upper" is used to denote those pieces and components of a shoe that cover the foot above the sole. In the context of this invention it includes any structure adapted for engaging the foot or an existing shoe in such a fashion as to hold the disclosed sole on the foot of a wearer. An upper may include such things as a lace closed bag of material, a series of straps or a sheet of contact adhesive.

The sole has an upper surface on which the wearer's foot rests during use of the sole. The wearer's foot may be placed directly on the sole or may be separated by layers of material such as a lasting board, sockliner or other components. The wearer's foot may also be displaced above the upper surface of the sole by an existing shoe, as would be the case when the sole is attached as an overshoe to enhance exercise when more traditional footwear is being worn. The sole may have side walls that extend above the plane of the upper surface, as would be the case when a foam midsole forms a wrap onto an upper or a rubber cupsole is provided.

The sole has a lower surface which may be adapted for ground contact such as by the inclusion of abrasion resistant solid rubber on the surface or the provision of a ground gripping tread or cleat configuration.

The sole is invisibly divided into regions according to the overlying parts of a wearer's foot during use. These regions are the heel, the midfoot, the forefoot and the toe area. The sole upper surface has a rear edge and a front edge. The length of a sole is the distance between the front and rear edges of the upper sole surface measured linearly along the longitudinal axis.

The heel region is generally below a wearer's calcaneous and is approximately the rear 20-30% of the sole length (from 0% to about 20-30%). The midfoot is the region forward of the heel but behind the region corresponding to the ball of the foot which is referred to as the forefoot. The midfoot extends about from 20-33% to 55-60% of the sole length measured from the rear edge of the sole upper surface. The forefoot is about 55-60% to 85-90% of the length of the sole from the rear edge of the sole upper surface. The toe region includes the sole area below the phalanges of a wearer and any additional sole material forward of this region. It extends from 60-85% to 100% of the sole length from the rear edge of the sole. The variation in the position of regions is due to individual differences in the proportions of foot parts of wearers. For the above locations of the regions of a sole, the specified percentages refer to approximate beginning and ending points of each region, specified as the percentage of the distance from the terminal heel point to the terminal toe point. Thus, for example, the midfoot extends about from a point which is about 20-30% of the distance from the rear edge to the front edge of the sole, to a point which is about 55-60% of the distance from the rear edge to the front edge of the sole.

Naming invisible regions does not indicate a need for the sole to physically extend through these areas, since the forefoot region is the only area where material must be included for the sole to function in certain preferred embodiments.

The sole has a longitudinal axis defined by a line generally connecting the mid points of the heel and forefoot regions of the sole or connecting their extrapolated positions if these regions are not physically present. The horizontal width of the sole is measured at about 90° to the longitudinal axis and parallel to the ground. The vertical thickness is measured at about 90° to the longitudinal axis and about 90° to the ground.

The sole has a thickness between the upper and lower surfaces along the longitudinal axis. This thickness is at a maximum in the forefoot region. Thus, the lower surface of the heel and forefoot of a wearer will be parallel to the ground or the heel will be lower than the forefoot when the forefoot lower surface of the sole is in ground contact and the wearer's foot urges the heel region onto the ground.

The lower surface of the sole is radiused at the vertical thickest point about a line generally connecting the mid-points of a wearer's first and second metatarsal-phalangeal joints.

"Radiusing" means the providing of a generally cylindrical curvature to the surface about a linear axis. This radiusing produces a sole with a forefoot region which is thinner on either side of the vertical thickest part along the longitudinal axis but is generally of even vertical thickness across a horizontal width about perpendicular to the longitudinal axis. This radiused section must be at least 10 mm wide in a shoe built on a last of net length 290 mm, measured along the longitudinal axis, to provide an adequate rolling action. This minimum width of the radiused section is reduced or enlarged in direct proportion to the length of the last bottom used to construct a sole. As described below, an appropriate radius length would be in the range 15 to 150 mm in a shoe with an upper sole surface length of about 275 mm. As indicated above, the curvature approximates the curvature of a circular cylinder, but may describe a curve which is slightly elliptical or has variable or other curvature which approximates a circular curve.

Distal to the radiused portion, the lower surface of the sole may have any of a variety of shapes, including curvatures of different radii.

The sole may be made of a great number of different materials foams such as ethylene vinyl acetate (EVA) or polyurethane (PU) with a rubber lower surface would be one possible form. Since the geometry of the sole is the crucial element in its function, a great many other combinations may be envisaged. For example; injection molded plastics, metal, carbon fiber, solid rubber, wood, other composites or polymers could be used as elements or as the entirety of the sole structure. The upper may be made of any material and may be structured in any of the many known forms in the footwear industry.

The sole functions by providing a fulcrum about which the wearer's foot rotates during exercises characterized by such actions as running, jumping or power walking which include a contraction of the posterior muscles of the lower leg. This fulcrum is in the form of a thickened forefoot which does not prevent the wearer's heel from reaching an equal or lower position than their forefoot when the sole is in ground contact. The fulcrum is further defined by the lower surface being curved on a radius generally about and aligned with a line connecting the mid points of a wearer's first and second metatarsal-phalangeal joints.

The term "generally", as used herein refers to an approximate positional relationship to other parts of the sole, article of footwear, or wearer's foot. However, it does not denote a precise position. Thus, for example, a line generally connecting the midpoints of the first and second metatarsal-phalangeal joints refers to a line approximately through the mid-points of those joints, but not necessarily precisely. In part, the approximate relationship shows recognition that wearers' feet differ, so that the positions or regions of a manufactured sole in relation to a wearer's foot will vary slightly depending on the shape and size of the foot and the fit of the article of footwear to which the sole is attached or is an integral part.

Thus, in a first aspect the sole has an upper and lower surface, and a thickness between the upper and lower surfaces. The thickness has a greatest vertical thickness in the forefoot region. The lower surface of the sole has a generally cylindrical curvature below the greatest thickness; the axis of the cylindrical curvature generally passes through the mid-points of the first and second metatarsal joints of a wearer's foot.

In a second aspect, the sole has an upper surface, a lower surface, a longitudinal axis, and a thickness between the upper surface and the lower surface. When the sole is part of an article of footwear or attached to an article of footwear, the article of footwear has a length defined by the distance from the terminal heel portion to the terminal toe portion. The thickness has a greatest vertical measurement at a point which is approximately 55-90% of the length measured along the longitudinal axis. The lower surface has a generally cylindrical curvature below the greatest thickness; the axis of the cylindrical curvature is oriented generally parallel to the upper surface of the sole, and at an angle of between 78° and 102° to the longitudinal axis.

In a related aspect, the sole has an upper surface having a rear edge, a front edge, and a length between the front and rear edges. The sole also has a lower surface, a thickness between the upper and lower surfaces, and a longitudinal axis. The thickness is greatest at a point between about 55% and 90% along the length measured from the rear edge along the longitudinal axis. The lower surface has a generally cylindrical curvature below the greatest thickness. The cylindrical curvature has a radius about a generally linear axis. The orientation and dimensions of the axis and radius of the cylindrical curvature are as described for the preceding aspect.

In a fourth aspect, the sole has an upper surface, a lower surface, and a thickness between the upper lower surfaces. The sole has its greatest thickness generally below the first and second metatarsal-phalangeal joints of a wearer's foot. The lower surface has a generally cylindrical curvature below the greatest thickness; the cylindrical curvature is generally radiused about a line passing through the mid points of the first and second metatarsal-phalangeal joints of the wearer's foot.

In preferred embodiments of the above aspects, the sole may physically have a heel region, a midfoot region, a forefoot region, and a toe region, or one or more of the regions other than the forefoot region may physically be absent. Thus, in a preferred embodiment, in use at least the forefoot of a foot of a wearer rests on the upper surface of the sole. Also in a preferred embodiment, the sole is attached to an existing article of footwear. Also in preferred embodiments, the sole is fixedly attached to an upper to form an article of footwear; the upper may be adapted to fit over an existing article of footwear. Also in preferred embodiments, the sole is attached to at least one strap; the upper surface is at least partially bounded by a strap; the sole includes a midsole and an outsole; the lower surface is wider than the upper surface at at least one point; the lower surface includes at least a portion lying in a plane tangential to the cylindrical curvature; the thickness includes at least one pillar; the sole includes a midsole made of a material selected from EVA, PU, wood, hard plastic, and sponge rubber; the thickness includes a rigid shank; the thickness includes at least one undercut; the lower surface includes a laterally inclined bevel, the lower surface includes a reinforcing shank; and the upper surface is at least partially bounded by a cupsole.

Other features and advantages of the invention will be apparent from the following description of the preferred embodiments and from the claims.

DETAILED DESCRIPTION OF THE PREFERRED EMBODIMENTS

Figure 1:
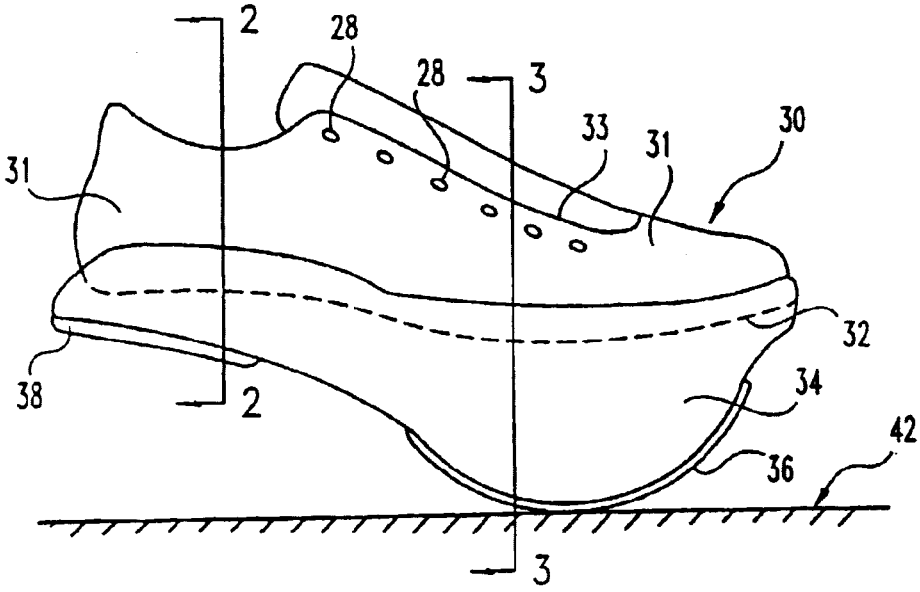
FIG. 1 is a side elevational view of an article of footwear in accordance with the present invention.

Referring to FIG. 1, an upper 30 may be of any form desired. The upper 30 is any mechanism suitable for holding the sole of this invention in position on the foot of a wearer during use. A specific example for this preferred embodiment includes a leather vamp and quarter 31 with a U-throat opening 33. Lace holes 28 are provided for drawing the upper 30 closed about the foot with a lace (not shown). The upper 30 is secured to the top surface of the sole 32 by cement and by the inclusion of a lasting board 40 (see FIG. 2) in a California slip last construction. Any other methods and constructions may be used for the forming of an upper and its attachment to the sole of this invention. For example, string lasting, flat cement lasting, moccasin construction or welting may be employed. The upper 30 may be directly injection molded with a sole, a series of foot encompassing straps may be attached to the sole, the sole may be attached by stitching, stapling, nailing or solvent bonding.

The upper surface of the sole 32 corresponds to the profile of a last used for the construction of the shoe. The only essential part of the upper surface of the sole 32 is that part below the forefoot of a wearer.

A midsole 34 of firm resilient EVA foam is provided between the upper 30 and the ground 42 contacting rubber outsole sections 36 and 38. A hardness of Shore 'C' 60 or higher is desirable for the midsole 34. It is possible to make the midsole in any of a great many ways and materials, including blow molding or injection molding plastics, composites, leather, PU, sponge rubber, wood, cork or metal.

The outsole sections 36 and 38 may alternatively be made of material such as reground urethane, PU, polyvinyl chloride (PVC), synthetic rubber or rubber-like polymers. Another possible form combines the midsole 34 and outsole 36, 38 into a single unit of manufacture, such as a solid rubber, PU or EVA molded sole. The term sole is used in this patent to encompass all combinations of parts to form the geometric sole shape required for the functioning of this invention.

Figure 2:
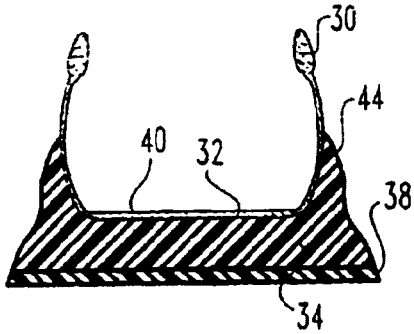
FIG. 2 is a vertical, transverse sectional view through the heel of the shoe of FIG. 1.

Referring to FIG. 2, the heel region includes parts of the upper 30 and lasting board 40 attached to the upper surface 32 of the sole by cement. This preferred embodiment includes a portion of the midsole 34 forming a wrap 44 onto the upper 30 to increase security or the bond and aid in stabilizing the wearer's heel during use of the shoe.

The midsole 34 and wrap 44 may be formed by compression molding of EVA foam. The outsole 38 is wider than the upper surface 32 of the sole to provide a stabilizing benefit during heel to ground contact. Outsole 38 may be attached to the midsole 34 with cement. The out flaring of midsole 34 to make a pyramidal shape is not obligatory and may be left off to decrease weight or reduce costs.

Figure 3:
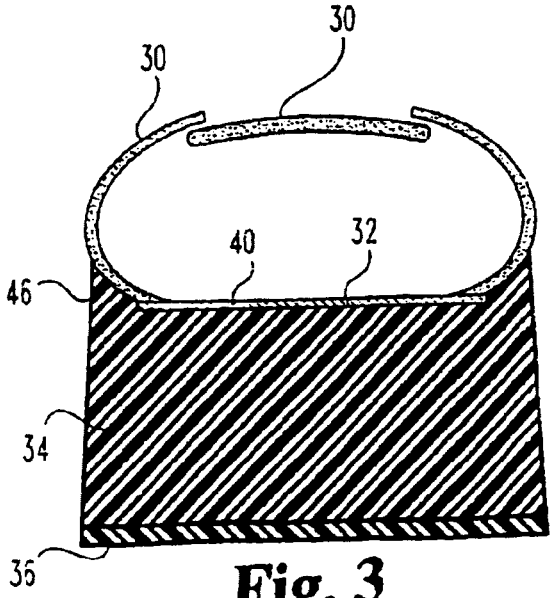
FIG. 3 is a vertical, transverse sectional view through the forefoot of the shoe of FIG. 1.

Referring to FIG. 3, the upper 30 and lasting board 40 are attached to the upper surface 32 of the sole. The midsole 34 forms a wrap 46 onto the upper 30 to improve bonding and increase stability of the forefoot during jumping motions. The outsole 36 is generally a sheet of thin rubber including a tread pattern. Alternatively the outsole 36 may include lugs or cleats to engage the ground 42 and enhance traction. Outsole 36 may be made by compression molding of rubber.

Figure 4:
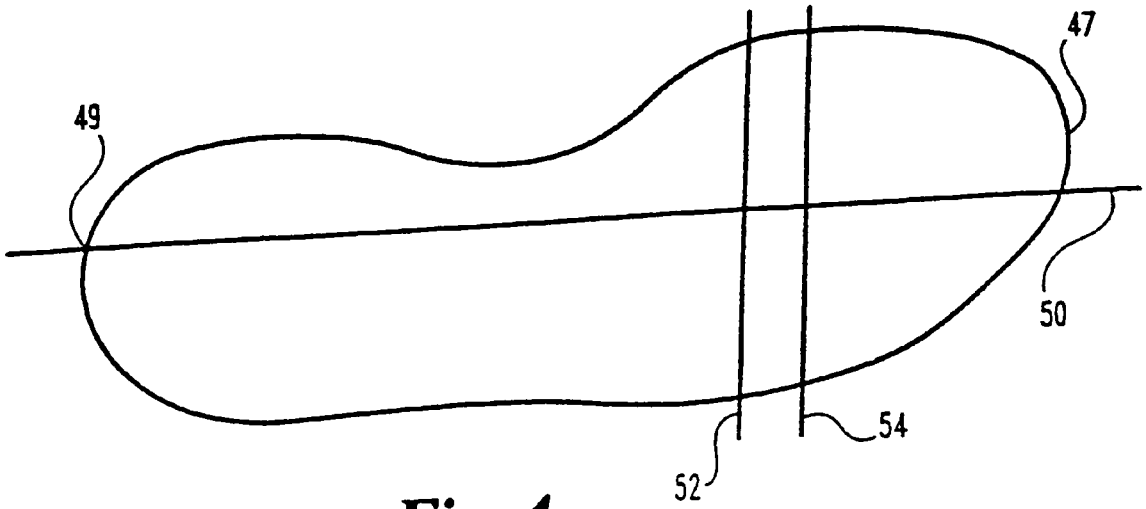
FIG. 4 is a top plan view of the sole of the shoe of FIG. 1.
Figure 5:
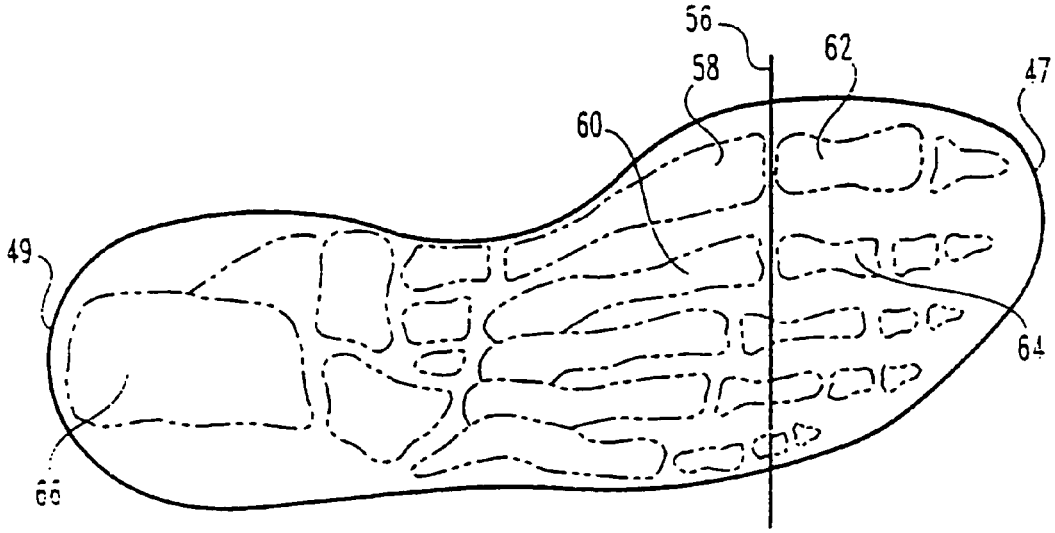
FIG. 5 is a top plan view of the sole of the shoe of FIG. 1, illustrating the location of the line connecting the midpoints of the first and second metatarsal-phalangeal joints.

Referring to FIGS. 4 and 5, the sole has an upper surface 32, a front edge of the sole upper surface 47 and a rear edge of the sole upper surface 49. The sole of a wearer's foot rests upon the sole upper surface 32 during use. The upper surface 32 has a longitudinal axis 50. The upper surface 32 generally corresponds to the bottom net of the last used for the manufacture of the article of footwear. The longitudinal axis 50 runs about from the middle of the heel region through about the middle of the forefoot region.

The first metatarsal 58 joints with the first phalange 62. The second metatarsal 60 joints with the second phalange 64. A line 56 may be drawn to connect the mid points of the first and second metatarsal-phalangeal joints. The sole has its greatest vertical thickness generally below the line 56. The line 56 lies between 8 and 25 mm above the bottom surface of the wearer's foot in a shoe of upper surface 32 length about 275 mm.

The lower surface of the sole is radiused about the line 56 so that the ground contacting portion of the forefoot region outsole 36 curves away from the ground on either side of the thickest vertical part of the sole when measured along the longitudinal axis 50. The radiusing provides a generally cylindrical curvature to the surface with line 56 as a linear axis. The radius length of the lower sole surface vertically below line 56 is calculated by adding the thickness of the outsole 36, the midsole 34, lasting board 40, the thickness of any other shoe components included below the forefoot of the wearer and the height of the line 56 above the sole of the wearer's foot. In the preferred embodiment, the radius would be about 65 mm. An appropriate radius value would be in the range 15 to 150 mm in a shoe with an upper sole surface 32 length of about 275 mm.

The height of the line 56 above the sole of the wearer's foot may be approximated by the addition of between 8 and 25 mm for shoes with a sole upper surface 32 length of about 275 mm. This figure of 8 to 25 mm may be prorated for foot size by adjusting in proportion to the length of the sole upper surface 32. The outside range of figures for the height of the line 56 above the sole of the foot for adult wearer's feet is 4-30 mm.

The greatest thickness of the sole is generally constant across the width of the sole below the line 56. Due to variations in individual's feet, the exact position of the line 56 and its angle to the longitudinal axis 50 will vary. The lines 52 and 54 show possible places for the line 56 in individuals with either short or long toes. The lines 52 and 54 are shown as being about perpendicular to the longitudinal axis 50 but a variation in angle of plugs or minus up to 12° may be present between different individuals. The line 56 will fall generally in the range delineated by lines 52 and 54. The line 56 will be inclined in the range 78°-102° to the longitudinal axis of the shoe. The position of the calcaneous 66 is a marker of the general position of the heel region of the sole.

OTHER EMBODIMENTS

Other embodiments are within the following claims. For example, referring to FIG. 6, an upper 30A is shown about a medial X-ray view of a wearer's foot resting on the upper surface 32A of a sole of this invention. The first phalange 62 and first metatarsal 58 meet at a joint as do the second phalange 64 and the second metatarsal 60. The line 56 joins the mid points of the first and second metatarsal-phalangeal joints and is shown in end view passing into the plane of the drawing.

The sole 35 is vertically thickest below line 56 and the radiused lower sole surface 72 is radiused about line 56. This radiused lower sole surface 72 extends at least 5 mm on either side of line 56 along the longitudinal axis of the shoe with a sole upper surface of 290 mm in length. The radiused section may be made longer than this but function will be lost if it is made shorter. In shoes built with a shorter upper surface length, the length of the radiused sole 72 may be reduced proportionally.

The sole 35 has more sharply angled walls 74 to give pleasing cosmetic effects and reduce the total volume of material thus saving costs and weight. The sole includes a heel 70 with a lower surface 68 aligned tangentially with the radiused lower sole surface 72. This provides a maximum area of sole to ground contact when the wearer's calcaneous 66 is pushed down while the radiused lower sole surface 72 is in contact with the ground 42.

Figure 7:
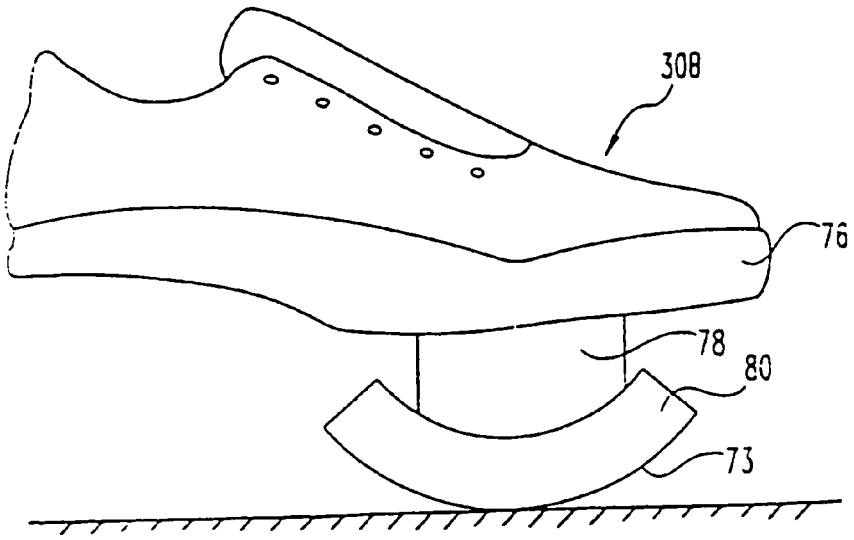
FIG. 7 is a diagrammatic representation of an embodiment of an article of footwear in accordance with the present invention.

Referring to FIG. 7, a shoe with upper 30B is furnished with a rubber cupsole 76, a pillar 78 of rigid rubber or foam and a radiused plate 80 with a ground contacting lower sole surface 73.

Figure 8:
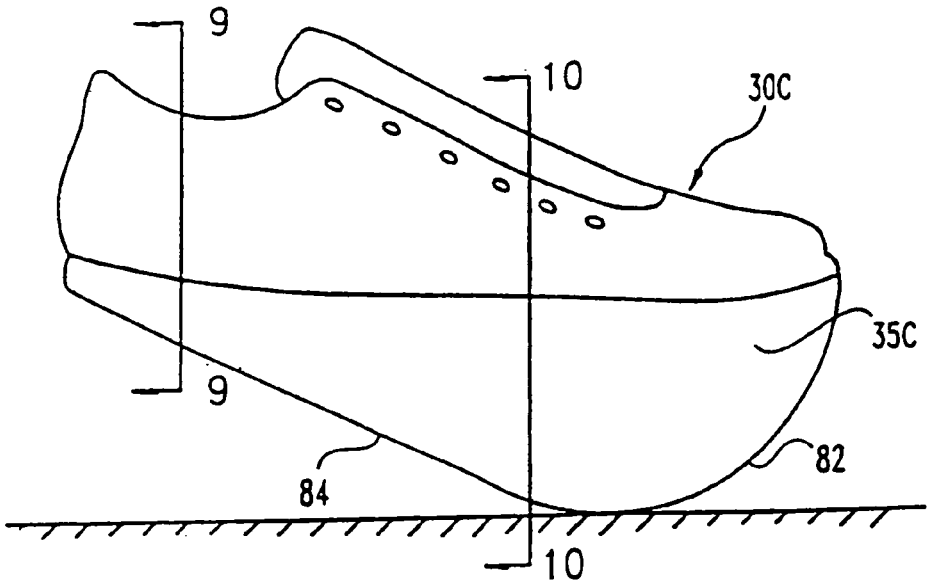
FIG. 8 is a diagrammatic representation of an embodiment of an article of footwear in accordance with the present invention.

Referring to FIG. 8, an upper 30C has a sole 35C such that the toe and forefoot region lower sole surface 82 is cylindrically curved about an axis through the first and second metatarsal-phalangeal joint mid points. The radius of the lower sole surface 82 is just great enough for the sole 35*c* to wrap onto the upper 30*c* at the front or the toe region. The midfoot and heel lower sole surface 84 is tangential to the radius of the forefoot lower sole surface 82.

Figure 9:
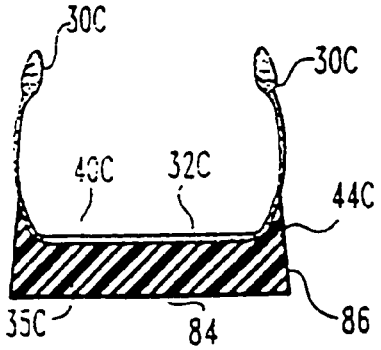
FIG. 9 is a vertical, transverse sectional view through the heel of the shoe of FIG. 8.
Figure 10:
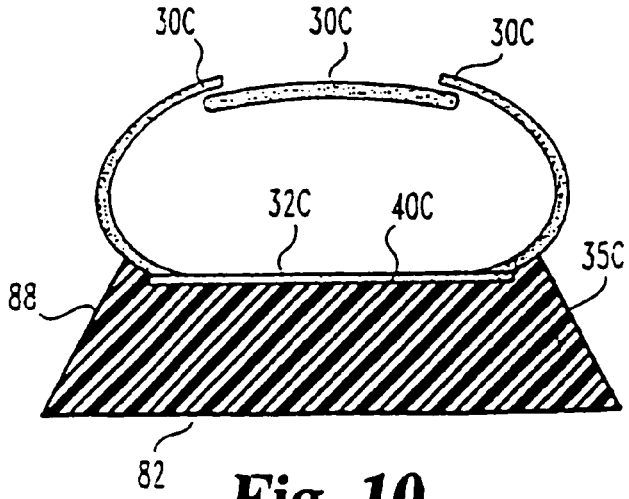
FIG. 10 is a vertical, transverse sectional view through the forefoot of the shoe of FIG. 8.

Referring to FIGS. 9 and 10, in one embodiment, the sole 35C includes a sole wrap 44C on to the upper 30C to a level above the top surface 32C of the sole and the lasting board 40C. The heel sole lower surface 84 is wider than the sole upper surface 32C which results in outflared sidewalls 86. The forefoot sole lower surface 82 is wider than the sole upper surface 32C which results in outflared side walls 88.

Figure 11:
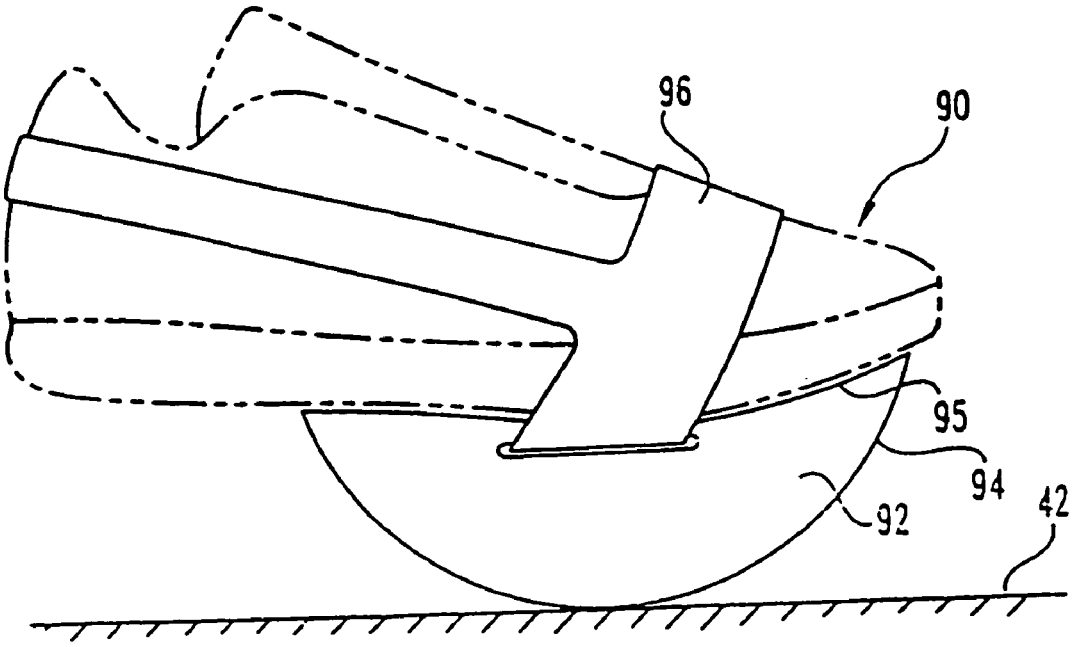
FIGS. 11, 12, 13 and 14 are side elevational views of articles of footwear in accordance with the present invention.

Referring to FIG. 11, one embodiment of the present invention includes a sole 92 with an upper surface 95 and lower surface 94. A strap system 96 formed of elastic gore, nylon web, neoprene spandex or other appropriate materials holds the sole 92 in place below a wearer's existing shoe 90. The sole 92 is held in position on the shoe 90 so that the combined vertical thickest part of the sole 92 and shoe sole 90 is below a line passing through the mid points of the wearer's first and second metatarsal-phalangeal joints. The surface 94 is cylindrically curved to make rolling contact with the ground 42 when the wearer's calf muscles contract.

Figure 12:
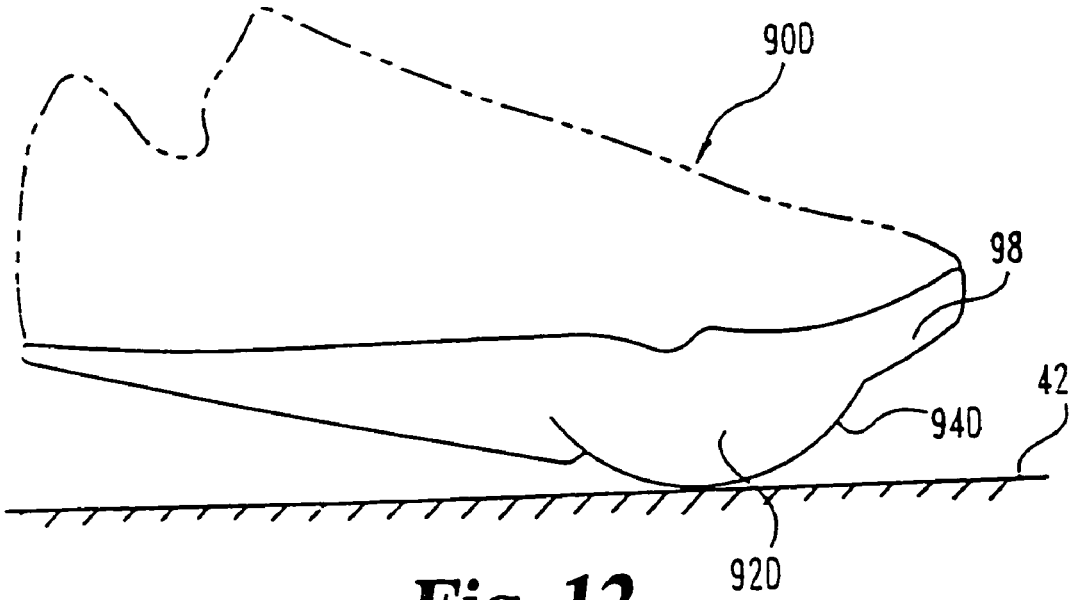

Referring to FIG. 12, In one embodiment, an existing upper 90D has a sole 92D attached with adhesive as a replacement sole. Any excess cement may be hidden by a cupsole 98. The function is provided by the radiused forefoot sole lower surface 94D as it contacts the ground 42.

Figure 13:
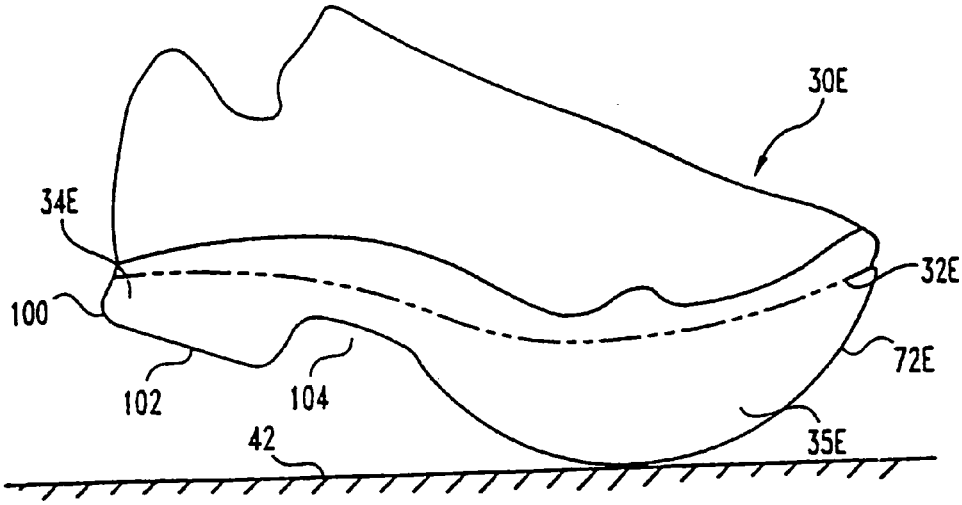

Referring to FIG. 13, an upper 30E is attached to the upper surface 32E of the sole 35E. The forefoot and toe region sole lower surface 72E is of sufficient radius to wrap onto the upper 30E at the front of the shoe. The sole 35E has a midfoot cut-out 104 to reduce weight. The heel region sole lower surface 102 is aligned tangentially with the radius of lower surface 72E. The rear of the heel 100 is rounded and a cushioning element is included in the midsole 34E to attenuate shock as the heel strikes the ground 42. Suitable cushioning elements include EVA or PU foam, air bags, gel bags or Hytrel springs.

Figure 14:
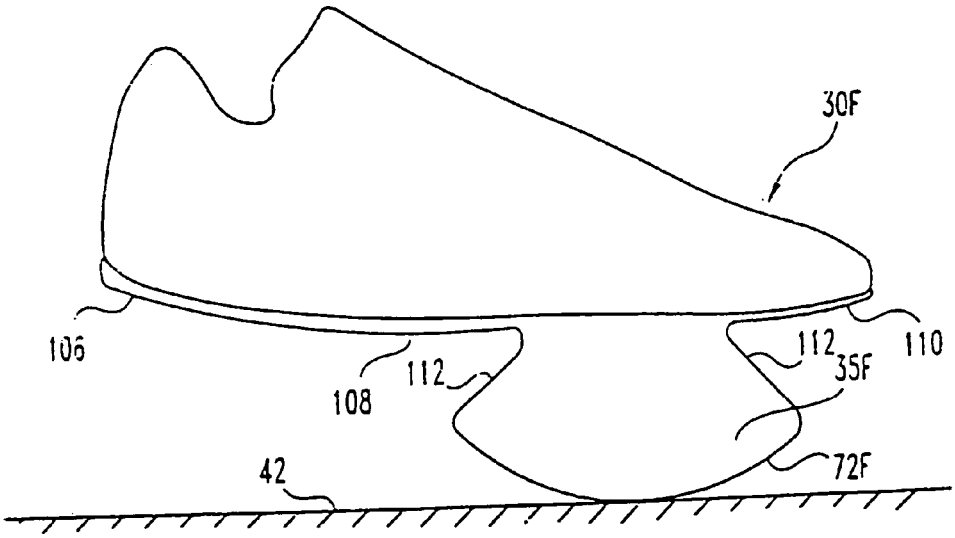
Figure 15:
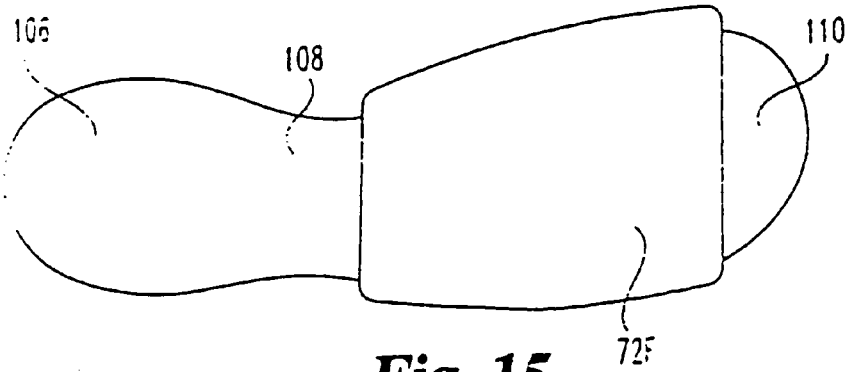
FIG. 15 is a bottom plan view of the article of footwear of FIG. 14.

Referring to FIGS. 14 and 15, an upper 30F is attached to a sole 35F with very thin sections in the heel 106 region, midfoot 108 region and the toe 110 region to reduce weight. Suitable materials would include hard rubber, plastic or composites. A thicker sole 35F is provided in the forefoot region with a radiused lower surface 72F to make contact with the ground 42. Weight is further reduced by undercuts 112 in the sole 35F. An undercut is an area of the side wall connecting the upper surface of the sole and the lower surface of the sole devoid of material.

Figure 16:
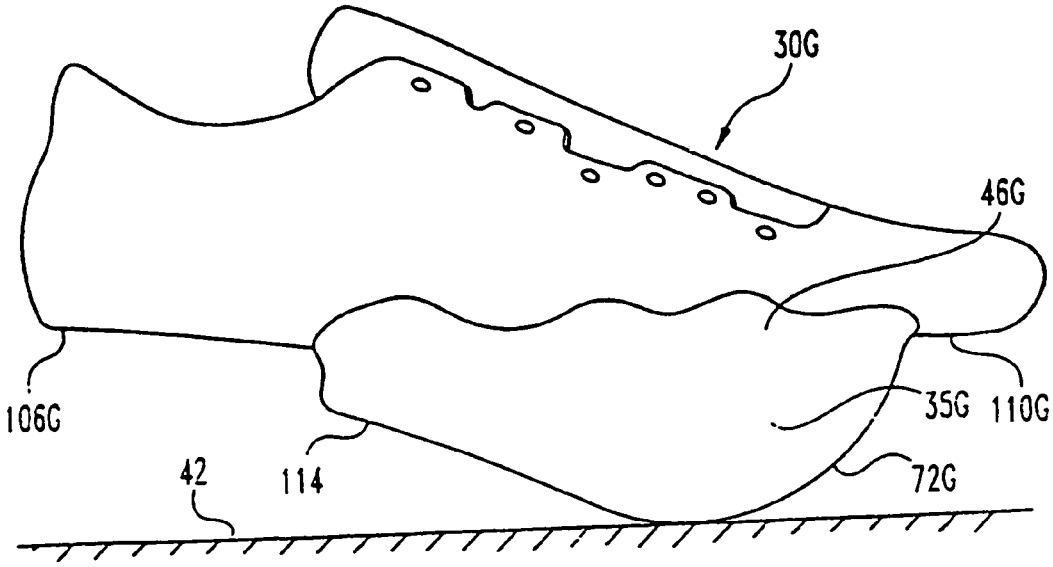
FIGS. 16, 17, and 18 are side elevational views of articles of footwear in accordance with the present invention.

Referring to FIG. 16, upper 30G is attached to a sole 35G which features a radiused forefoot lower surface 72G contacting the ground 42 in use. The sole midfoot lower surface 114 is tangential to the radius of lower surface 72G. Very thin material is provided in the heel 106G and toe 110G regions. Sheet steel or carbon fiber epoxy composites would suffice for heel 106G and toe 110G. The sole 35G includes a wrap 46G onto the upper 30G.

Figure 17:
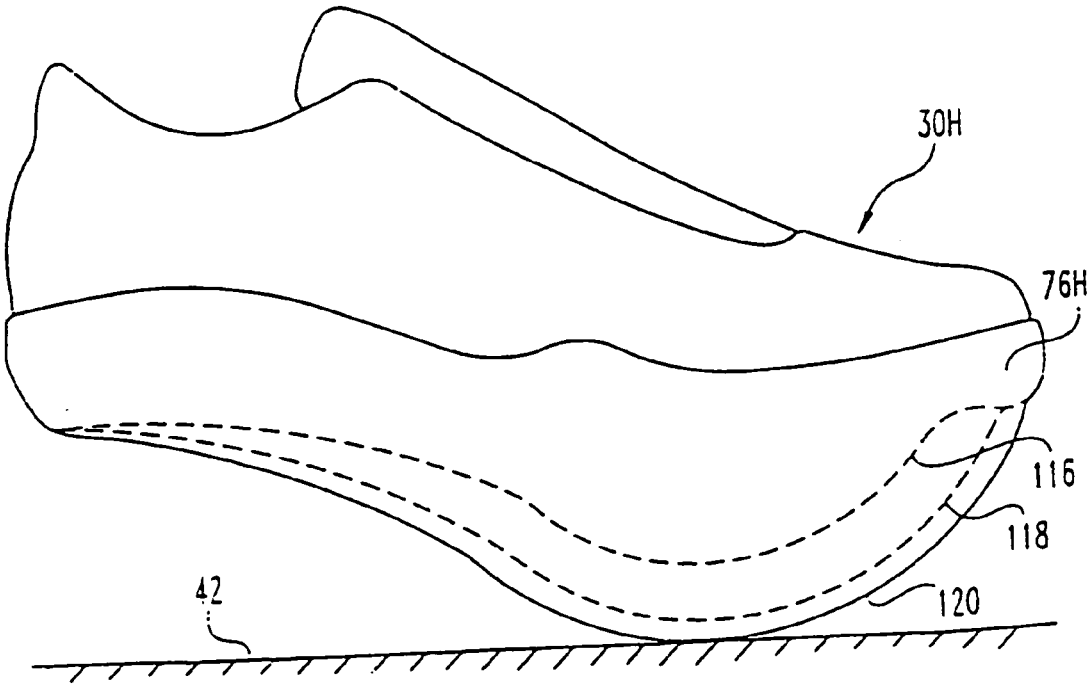

Referring to FIG. 17, different shoes built with the same sized upper 30H may be manufactured with different sole lower surfaces 116, 118 or 120. Whilst the radii of the three soles are different, the center of rotation and longitudinal alignment are the same. The soles may be attached with a cupsole front wall 76H. The smaller radius lower surface 116 would be used by beginners, the medium radius lower surface 118 would be used by intermediate level athletes and the large radius lower surface 120 would be used by advanced athletes.

Figure 18:
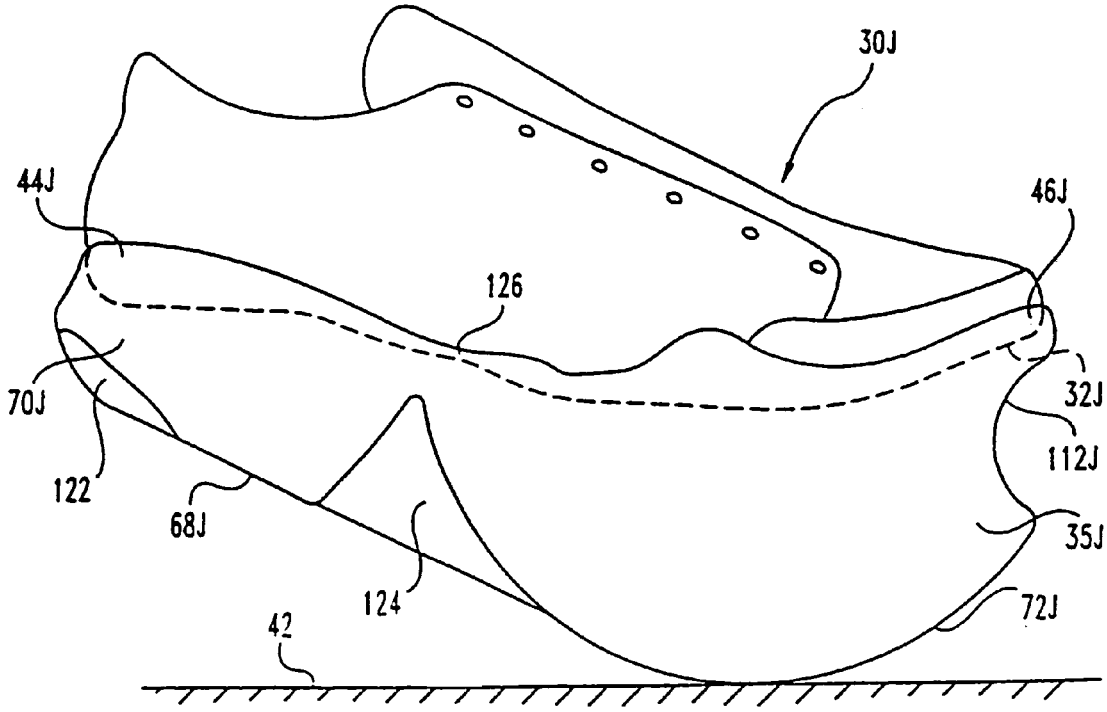
Figure 19:
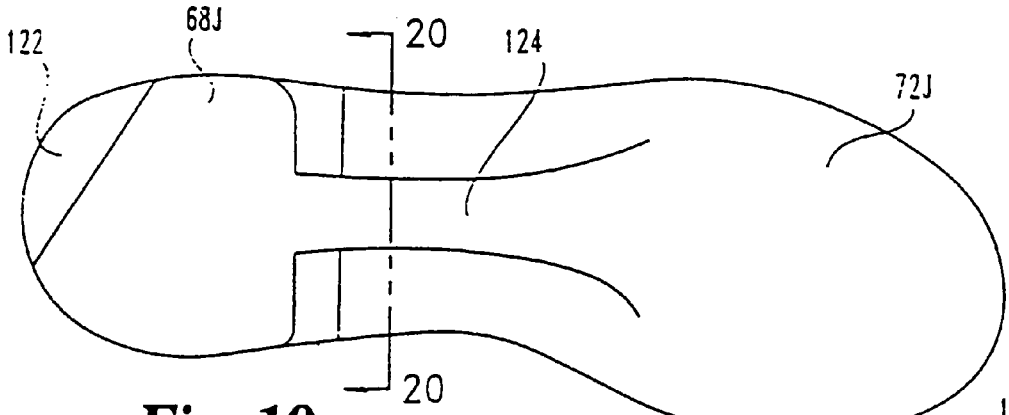
FIG. 19 is a bottom plan view of the sole of FIG. 18.
Figure 20:
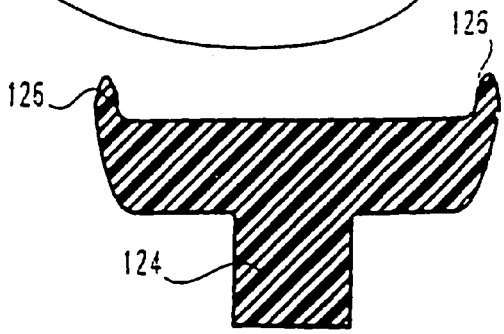
FIG. 20 is a vertical, transverse sectional view through the midfoot of the sole of FIG. 19.

Referring to FIGS. 18, 19 and 20, an upper 30J is attached to a sole 35J by direct injection to produce bonding to the upper surface of the sole 32J, a wrap 44J in the heel region and a wrap 46J in the toe region. The sole in the heel region 70J includes a laterally inclined bevel 122 and a lower surface 68J tangential to the radius of the forefoot sole lower surface 72J. Weight is reduced by an under cut 112J in the toe region and by cutting material out of the midfoot to leave only a reinforcing shank 124. Sole 35J stiffness in the midfoot is further enhanced by wraps 126 onto the upper 30J.

Referring to FIGS. 21 A-C, an upper 30K is attached to a sole 35K with a large radius to the sole and forefoot lower surface 82K. The large radius provides a smooth transition into a wrap 134 onto the upper 30K above the sole upper surface 32K. To stabilize the thicker sole arising from the larger radius, the sole lower surface edge 130 is extended backwards at the heel 128 and is made wider across the forefoot region relative to the sole upper surface edge 132.

Figure 22:
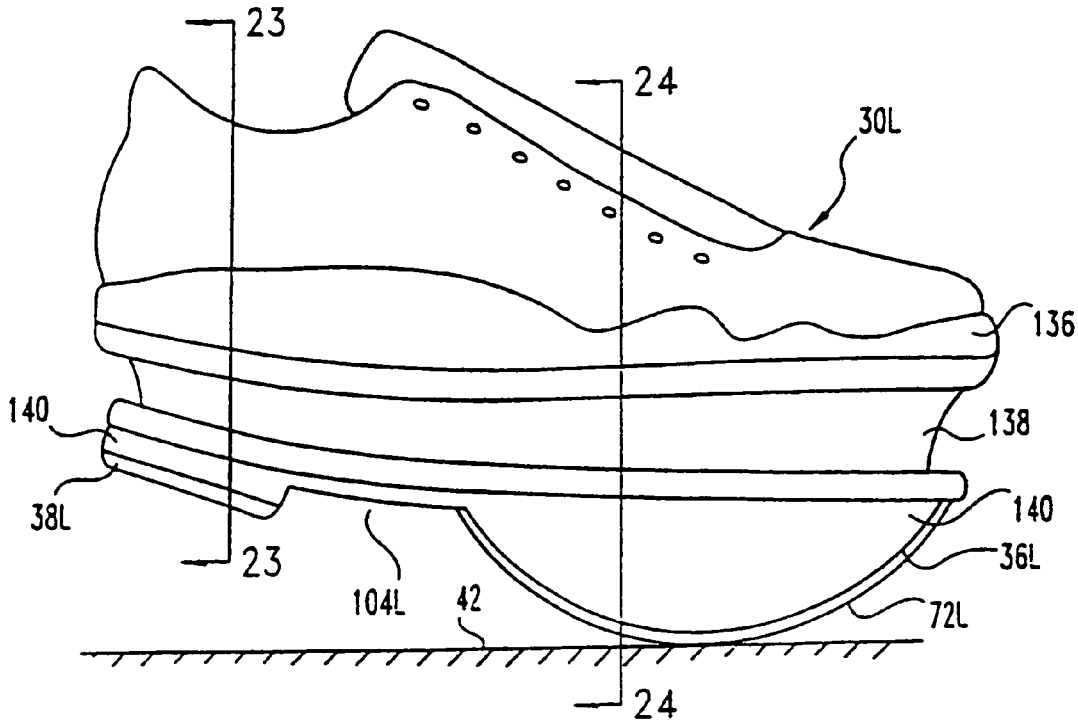
FIG. 22 is a side elevational view of an article of footwear in accordance with the present invention.
Figure 23:
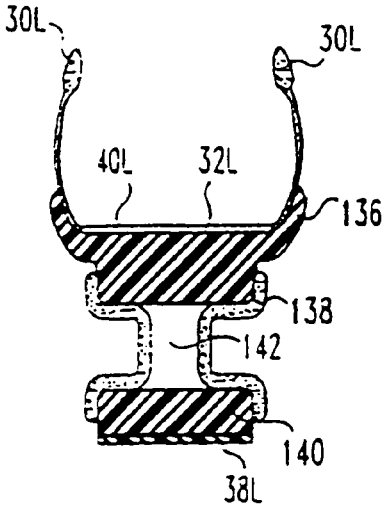
FIG. 23 is a vertical, transverse sectional view through the heel of the shoe of FIG. 22.
Figure 24:
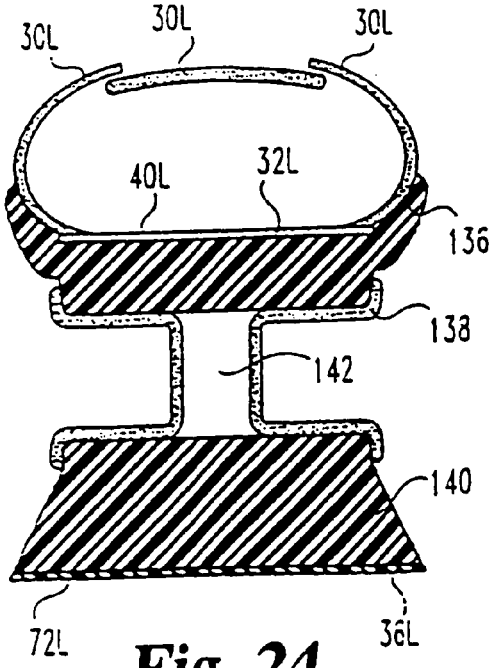
FIG. 24 is a vertical, transverse sectional view through the forefoot of the shoe of FIG. 22.

Referring to FIGS. 22, 23 and 24, an upper 30L is attached to a foam cup 136 with an upper sole surface 32L below the lasting board 40L. The foam cup 136 is inserted into a composite or molded plastic rigid shank 138. The shank weight is reduced by inclusion of an air space 142. A lower foam sole 140 is inserted in the rigid shank 138 and equipped with rubber outsole sections 38L in the heel and 36L in the forefoot. The forefoot lower sole surface 72L is cylindrically curved or radiused about a line passing through the first and second metatarsal-phalangeal joints of a wearer and contacts the ground 42.

Figure 25A:
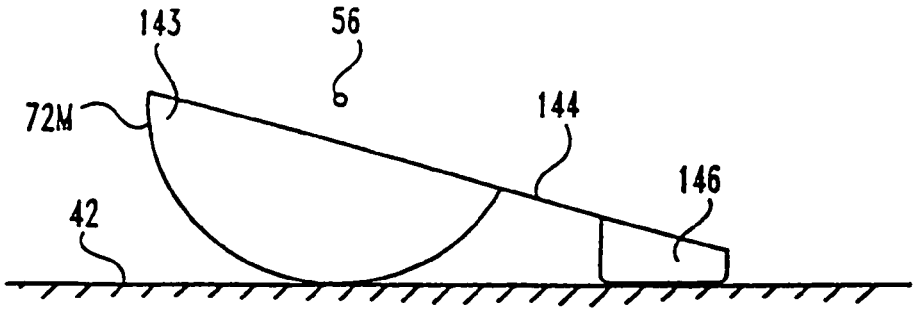
FIGS. 25 A-C are side elevational views of a sole of the present invention.
Figure 25B:
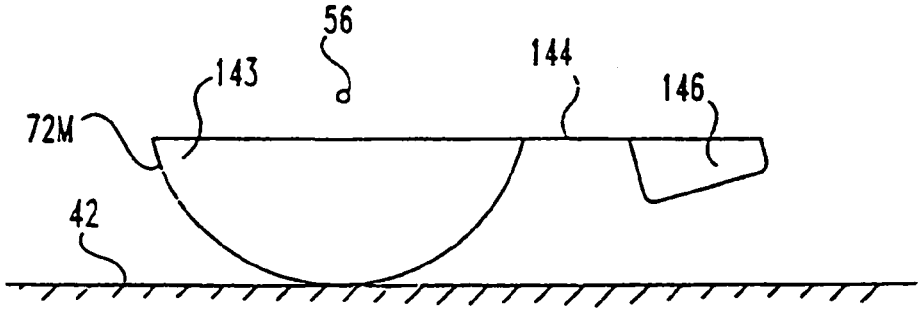
Figure 25C:
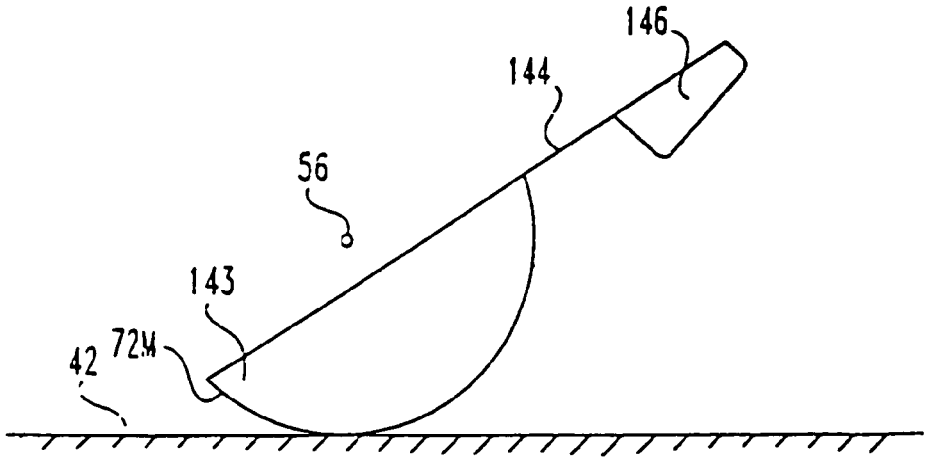

Referring to FIGS. 25 A-C, sole 143 has a generally flat upper surface 144, a heel 146 and a radius to the lower surface 72M about the line 56 to make rolling contact with the ground 42.

OPERATION OF INVENTION

Referring to FIGS. 1, 2, 3, 4 and 5, the midsole 34 and outsole 36 form the complete sole which functions by providing a fulcrum about which the wearer's foot rotates. This rotation is generated during exercises characterized by such actions as running, jumping or power walking which include a contraction of the posterior muscles of the lower leg. This fulcrum allows the heel to reach an equal or lower position than the forefoot when the sole is in ground 42 contact. This permits a full range of motion of the ankle and calf muscles. This function is achieved by making the vertical thickness of the forefoot midsole 34 and outsole 36 shown in FIG. 3 equal or greater than the total thickness of the heel midsole 34 and outsole 38 shown in FIG. 2.

The fulcrum is further refined by the lower surface of the outsole 36 being generally cylindrically curved with an axis of line 56. Line 56 connects the mid point of a wearer's first metatarsal 58 and first phalange 62 joint to the mid point of a wearer's second metatarsal 60 and second phalange 64 joint. This permits a natural rolling forward of the sole as the calf muscle is contracted. The resistance will be fairly constant due to the constant length of the lever arm between the upper surface of the sole 32 under the forefoot and ground 42. This arrangement also causes line 56 to stay about a constant distance from ground 42 during the forward rolling motion of the sole. Improved stability is offered by wrapping the midsole 34 onto the upper 30 to form a lip, bead or wrap 44 in the heel or wrap 46 in the forefoot.

Figure 6:
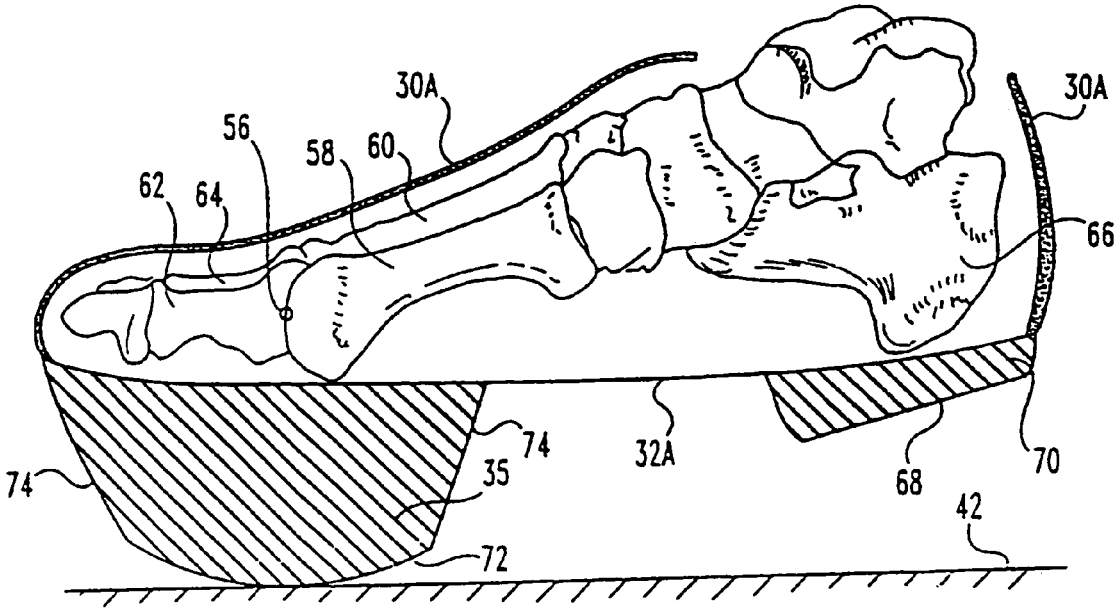
FIG. 6 is a schematic side elevational view of an article of footwear in accordance with the present invention illustrating the location of the line connecting the midpoints of the first and second metatarsal-phalangeal joints.

Referring to FIG. 6, the radiused lower surface 72 of sole 35 is limited in extent to allow interesting cosmetic shaping of the walls 74. A heel 70 may be provided with a sole lower surface 68 set tangentially with the radius of the sole lower surface 72. This gives a maximal area of lower surface 68 contact and support when the heel 70 and forefoot lower surface 72 are in ground 42 contact simultaneously. This arrangement also reduces wear of the lower surface 68.

Referring to FIG. 7, the pillar 78 contributes to the vertical thickness in the forefoot region. Pillar 76 is terminated by plate 80 with a lower surface 73.

Referring to FIG. 8, the sole 35C is has flared walls 86 and 88 in the heel and forefoot respectively, to enhance stability. The sole lower surface 84 extends through the heel and midfoot to join the radiused sole lower surface 82 tangentially in the forefoot. This adds torsional rigidity and shank stiffness. This embodiment also results in an increased surface area of the lower surface 84 providing greater abrasion wear resistance.

Referring to FIG. 11, It is sometimes desirable to wear a traditional type of shoe in athletic training and change shoes for periods of plyometric training. The strap structure 96 or analogous attachment systems well know in the footwear industry such as hook and loop closures or neoprene spandex bags, allow the temporary addition of the sole of this invention to a traditional shoe 90. The radius of the overshoe sole 92 is manufactured to align the center of rotation of the cylindrically curved lower surface 94 with the line joining the mid points of a wearer's first and second metatarsal-phalangeal joints. The thickness of a traditional sport shoe sole under the forefoot is in the range 3 to 15 mm which is allowed for in the thickness of the sole 92 during production.

Referring to FIG. 12, it is a common practice to resole worn out traditional sport shoes. This resoling may be done with a sole of this invention such as the sole 92D with a cupsole 98 construction and a radiused sale lower surface 94D. The existing sole of the worn upper 90D is heat striped, an adhesive applied to the sole upper surface of sole 92D and the lower surface of the upper 90D and the two surfaces brought together while the adhesive is still tacky.

Referring to FIG. 13, material is removed from the midfoot with a cut out 104. This may be done by molding the foam or physically cutting out a section of the structure. Rounding the rear border of the heel 100 reduces sole wear in this area if the heel strikes the ground during rapid forward motion with the toes fully elevated. This structure also improves the forward rolling action of the foot to bring the heel sole lower surface 102 and forefoot sole lower surface 72E smoothly into contact with the ground.

Referring to FIGS. 14 and 15, sole weight may be reduced by offering a form with the heel 106, midfoot 108 and toe 110 regions devoid or nearly devoid of the sole 35F. The weight may be further reduced by cutting or molding the sole 35F with undercuts.

Referring to FIG. 16, it is possible to reduce weight and still support the shank with the sole 35G and wraps 46G by leaving the heel 106G and toe 110G regions devoid or nearly devoid of sole 35G.

Referring to FIG. 17, as the length of the radius in the sole forefoot of this invention is increased, the moment of inertia of the wearer's body will be increased, requiring additional work to roll the shoe forward. This biomechanical fact can be used advantageously by offering shorter radius soles, such as the one bounded by sole lower surface 116, for less strong athletes. As the athletes gain in strength, progressive resistance is needed to continue the improvements associated with physical training. This additional resistance may be provided by changing to a sole of longer radius in the forefoot, such as one delineated by lower sole surface 118 or 120.

Referring to FIGS. 18, 19 and 20, in running type motions, the foot is slightly supinated during the swing phase. This can result in landing on the posterio-lateral aspect of a heel and increase wear at that point. Providing a laterally facing heel bevel 122, this wear effect may be mitigated. As an athlete tires in training, they may allow the foot to collapse in the midfoot area. This is resisted by the shank stiffness of the shoe in the midfoot area which may be increased by including a reinforcing rib 124 connecting the heel and forefoot regions of the sole 35J.

Figure 21A:
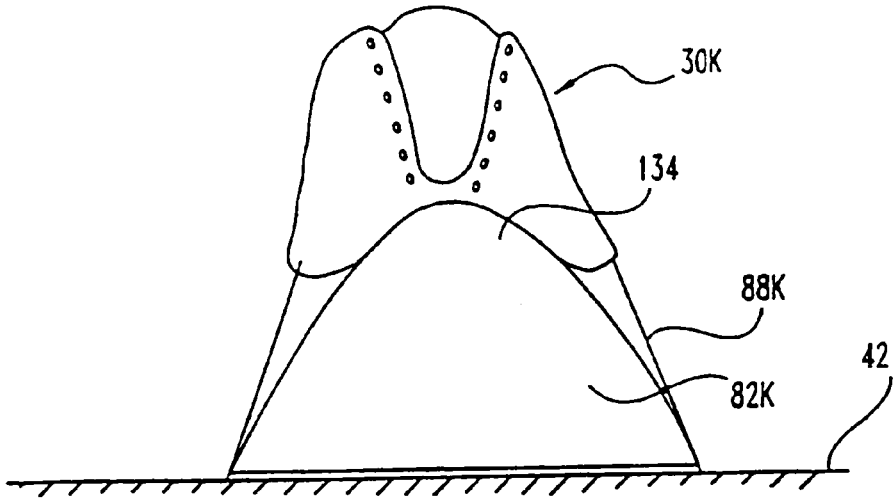
FIGS. 21A-C are front elevational view, side elevational view and top plan view of a sole in accordance with the present invention.
Figure 21B:
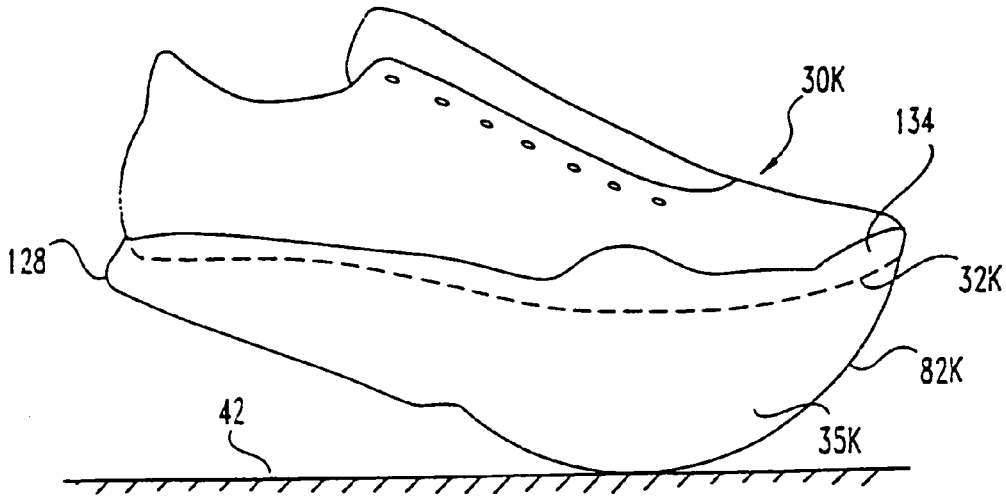
Figure 21C:
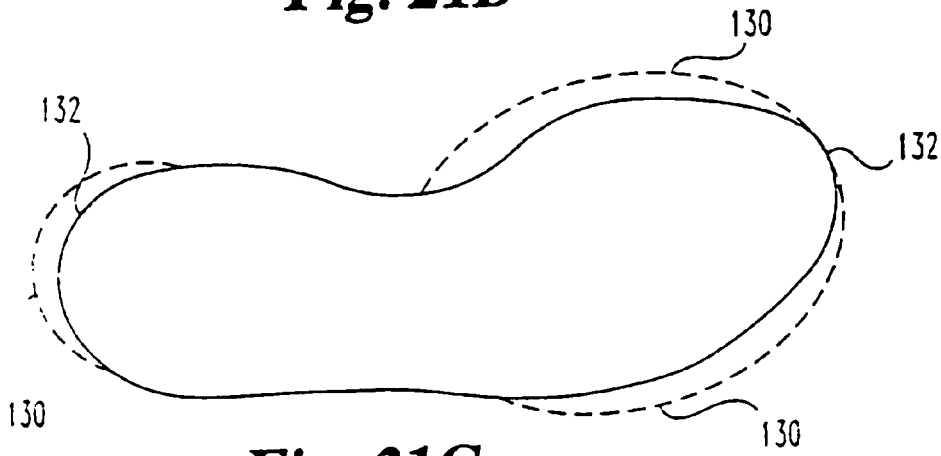

Referring to FIGS. 21A, 21B and 21C, using a large radius for sole toe and forefoot lower surface 82K provides a constant lever arm during movements that keep the sole in contact with the ground and there is extreme plantar flexion of the foot.

Referring to FIGS. 22, 23 and 24. There are many possible structures that meet the geometric requirements of this invention and provide the intended biomechanical action. One example includes a carbon fiber composite or injection molded rigid shank 138 that has upper foam element 136 inserted for attaching the upper 30L and a lower foam element 140 inserted to retain heel outsole 38L and forefoot outsole 72L sections. The rigid shank 138 maintains the torsional stiffness of the sole during use.

Referring to FIGS. 25 A-C, as a wearer's calf muscles contract, the lower surface 72M rolls forward along the ground 42. The heel 146 is raised and the line 56 (shown here in end view) joining a wearer's first and second metatarsal-phalangeal joints remains generally at the same height above the ground 42 through the full range of motion.

Thus the reader will see that the exercise sole of the invention provides a full range of motion for the ankle in exercise, provides a continuous rolling motion for the foot, aligns this forefoot rolling motion with the primary axis of force exertion in jumping and provides a forefoot sole radius length appropriate for exercise of the calf muscles. The sole of the invention further reduces the forefoot to ground slapping action, scales the sole radius according to body dimensions and reduces the rubbing away that occurs in relatively flat soles.

While the above description contains many specificities, these should not be construed as limitations on the scope of the invention, but rather as an exemplification of one preferred embodiment thereof. Many other variations are possible. For example, a shell molded upper may have a sole of this invention attached by rivets or screws, the sole may be more flared medially than laterally, stabilizing side springs may be attached to the sole side walls, the lasting board may be furnished with tabs or extensions cut from the same sheet without stitching and upper components attached thereto, the sole may be used without any upper for a user to stand upon as an exercise device or the outsole may have cushioning benefit provided by an A-Frame sole structure. Accordingly, other embodiments are within the scope of the invention and the claims.

I claim:

1. A sole comprising: an upper surface, a lower surface, a longitudinal axis, a length extending from a heel region to a toe region, and a thickness between said upper surface and said lower surface, and wherein said thickness has a greatest vertical thickness in the forefoot region of said sole, and said lower surface has a generally cylindrical curvature below said greatest vertical thickness, said cylindrical curvature radiused about an axis line passing generally through the mid points of the first and second metatarsal-phalangeal joints of a wearer's foot, said axis line occurring above said upper surface, and said thickness decreasing non-linearly along said longitudinal axis on both sides of said greatest vertical thickness.

2. The sole of claim 1, wherein said sole comprises a midfoot region, and a forefoot region.

3. A sole comprising: an upper surface having a rear edge, a front edge and a length between said rear edge and said front edge, a lower surface, a longitudinal axis, and a thickness between said upper surface and said lower surface, wherein said thickness has a greatest thickness at a point between 55% and 90% along said length measured from said rear edge along said longitudinal axis, said lower surface has a generally cylindrical curvature below said greatest thickness, said cylindrical curvature has a radius about a generally linear axis, wherein said radius is equal to said greatest thickness plus an amount in the range from 4 to 30 millimeters, and said linear axis is oriented generally parallel to said upper surface and at an angle to said longitudinal axis in the range from 78° to 102°, and said linear axis occurring above said upper surface, and said thickness decreasing non-linearly along said longitudinal axis on both sides of said greatest vertical thickness.

4. A sole comprising: an upper surface, a lower surface, a longitudinal axis, and a thickness between said upper surface and said lower surface, wherein when said sole is attached to an article of footwear, said article of footwear has a length described by a line from approximately the terminal heel portion to the terminal toe portion of said article of footwear, wherein said thickness has a greatest thickness at a point between 55% and 90% along said length measured from said terminal heel portion along the longitudinal axis of said article, said lower surface has a generally cylindrical curvature below said greatest thickness, said cylindrical curvature spans longitudinally from said point of greatest thickness both in a direction toward said terminal heel portion and in a direction toward said terminal toe portion and has a radius about a generally linear axis, wherein said radius is equal to said greatest thickness plus an amount in the range from 4 to 30 millimeters, and said linear axis is oriented generally parallel to said upper surface and at an angle to said longitudinal axis in the range from 78° to 102°, and said generally linear axis occurring above said upper surface, and said thickness decreasing non-linearly along said longitudinal axis on both sides of said greatest vertical thickness.

5. The sole of claim 1, wherein at least the forefoot of a foot of a wearer rests upon said upper surface during use.

6. The sole of claim 1, wherein said sole is fixedly attached to an upper to form an article of footwear.

7. The article of footwear of claim 6, wherein the upper is adapted to fit over an existing article of footwear.

8. The sole of claim 1, wherein said sole is attached to at least one strap.

9. The sole of claim 1, wherein said upper surface is at least partially bounded by a wrap.

10. The sole of claim 1, wherein said sole includes a midsole and an outsole.

11. The sole of claim 1, wherein said lower surface is wider than said upper surface at least at one point.

12. The sole of claim 1, wherein said lower surface includes at least a portion lying in a plane tangential to said cylindrical curvature.

13. The sole of claim 1, wherein said thickness includes at least one pillar.

14. The sole of claim 1, wherein said sole includes a midsole made of a material selected from EVA, PU, wood, hard plastic, and sponge rubber.

15. The sole of claim 1, wherein said thickness includes a rigid shank.

16. The sole of claim 1, wherein said thickness includes at least one undercut.

17. The sole of claim 1, wherein said lower surface includes a laterally inclined bevel.

18. The sole of claim 1, wherein said lower surface includes a reinforcing shank.

19. The sole of claim 1, wherein said upper surface is at least partially bounded by a cupsole.

20. A sole comprising: an upper surface, a lower surface, a longitudinal axis, a length extending from a heel region to a toe region, and a thickness between said upper surface and said lower surface, and wherein said thickness has a greatest vertical thickness generally below a first and second metatarsal-phalangeal joint of a wearer's foot, and said lower surface has a generally cylindrical curvature below said greatest vertical thickness, said cylindrical curvature radiused about an axis line passing generally through the mid points of the first and second metatarsal-phalangeal joints of a wearer's foot, said axis line occurring above said upper surface, and said thickness decreasing non-linearly along said longitudinal axis on both sides of said greatest thickness.

* * * * *